United States Patent [19]

Cotton

[11] Patent Number: 4,836,368

[45] Date of Patent: Jun. 6, 1989

[54] PREPARATION AND DISPENSING CONTAINER FOR HOT, MOIST TOWELS

[75] Inventor: James D. Cotton, Appleton, Wis.

[73] Assignee: Kimberly-Clark Corporation, Neenah, Wis.

[21] Appl. No.: 187,694

[22] Filed: Apr. 29, 1988

[51] Int. Cl.[4] ..... B65D 81/22

[52] U.S. Cl. ..... 206/205; 100/245; 206/216; 206/494; 206/812; 220/3.1; 220/212; 220/352

[58] Field of Search ..... 100/110, 116, 240, 245; 206/205, 209, 210, 216, 233, 449, 494, 812; 220/3.1, 212, 352

[56] References Cited

U.S. PATENT DOCUMENTS

| | | | |
|---|---|---|---|
| 1,195,370 | 8/1916 | Larsen | 100/116 |
| 2,619,029 | 11/1952 | Gherbaz | 100/240 |
| 3,154,853 | 11/1964 | Dubbeld | 100/240 |
| 3,784,056 | 1/1974 | Spruyt et al. | 221/309 |
| 3,836,045 | 9/1974 | Duhy et al. | 221/63 |
| 3,841,466 | 10/1974 | Hoffman et al. | 206/205 |
| 4,000,816 | 1/1977 | Spruyt | 206/498 |
| 4,428,497 | 1/1984 | Julius et al. | 220/339 |
| 4,593,615 | 6/1986 | Kehl | 100/245 |

*Primary Examiner*—Jimmy G. Foster
*Attorney, Agent, or Firm*—William D. Herrick

[57] ABSTRACT

The present invention is directed to preparation and dispensing of moist, hot towels which has become standard practice in international airline travel and is recognized as a desired passenger convenience. Limitations on cost, storage space, and airline attendant time have restricted the airlines' ability to make such a convenience more widespread. The present invention provides a compact, efficient means for containing, preparing and dispensing moist, hot towels that overcomes these drawbacks. As disclosed, the container of the invention includes a bottom formed at least partially of heat insulating material that is adapted to contain a stack of, for example, disposable towels and that has self-supporting sidewalls. A top cover is included that is similarly shaped, but of a slightly smaller dimension so that it will fit inside the cavity of the bottom. In use, the disposable towels are placed within the bottom cavity, and preferably using the cavity of the top, the desired amount of hot water is added to the towels. In cases where the bottom is less than full of towels, the top may be inverted and used to express excess water by pressing against the towels with the bottom tipped so as to drain the excess water. The hot, moist towels may then be dispensed one at a time. After use, the towels may be collected in the container, the top replaced and the entire contents discarded. Additional preferred embodiments disclosed are where the top and bottom are formed from expanded polystyrene, and have outwardly extending sides with the angle variation from vertical of the bottom sides in the range of up to 30° and for the top sides is about 2° to 10° less.

11 Claims, 4 Drawing Sheets

PREPARATION AND DISPENSING CONTAINER FOR HOT, MOIST TOWELS

FIELD OF THE INVENTION

The present invention is directed to dispensing containers particularly adapted to be used in connection with hot, moist disposable towels. It has become customary in airline travel in first class compartments and on longer flights for other passengers as well to provide hot, moist towels for passengers to refresh themselves prior to and after dining and at other times, depending upon the length of the flight. Other opportunities for using such hot, moist towels will be apparent such as, for example, banquet dining or other occasions where cleansing or refreshment for groups of people may be desired, such as in seafood restaurants. Airline passengers, in particular, have found such refreshment to be desirable, and the use of such hot, moist towels could be considered to provide a competitive advantage. More widespread use, however, has been hindered by the fact that the present practice of heating trays of such towels by sprinkling hot water requires that excess water be removed and that the towels be collected, stored and laundered. This procedure is time-consuming and, as a result, expensive, often occupying essentially the full time of a cabin attendant on larger-capacity aircraft. Accordingly, it is desired to provide a more efficient means for supplying airline passengers and others in appropriate circumstances with the benefit of such hot, moist towels without the attendant drawbacks of current methods. The container of the present invention is directed to such improvements and benefits.

BACKGROUND OF THE INVENTION

Numerous patents exist relating to containing and dispensing premoistened towelettes. Examples include U.S. Pat. No. 4,428,497 to Julius, Dwan and Tullar, dated Jan. 31, 1984; U.S. Pat. No. 4,000,816 to Spruyt, dated Jan. 4, 1977; U.S. Pat. No. 3,841,466 to Hoffman and Spruyt, dated Oct. 15, 1974; U.S. Pat. No. 3,836,045 to Duby and Jones, dated Sept. 17, 1974, and U.S. Pat. No. 3,784,056 to Spruyt and Hoffman, dated Jan. 8, 1974. None teaches or suggests containers adapted to package, moisten, heat, dispense and collect moist, hot towels.

SUMMARY OF THE INVENTION

The present invention is directed to a container means providing very efficient packaging, heating and dispensing of hot, moist towels. As such, it is particularly useful for airline travel, where the compact form and facilitated dispensing are of great significance. The container includes a bottom formed at least partially of heat insulating material and having a cavity of a size and shape to receive a plurality of towels. The sidewalls of the cavity preferably extend outwardly, forming a top opening larger than the bottom of the cavity. The bottom is combined with a cover having a size and shape to engage the bottom sidewalls with the top, having walls that are also tapered so that the exposed top surface of the cover is smaller than the top opening of the bottom. In use, dry towels are packaged and stored in the container and, when use is desired, the top is removed and a predetermined amount of hot water sprinkled liberally on top of the disposable towels, and then towels are dispensed.

In cases where unused towels remain for a subsequent use, they may be resaturated in the original container. After saturation of the towels in such a case, the top is inverted and used to squeeze excess water from the towels. The moist towels may then be dispensed from the bottom of the container individually and remain hot for an extended period of time.

Preferred embodiments include those where the top and bottom are made of insulating foam and also where the top and bottom sealingly engage in a pressure fit for packaging purposes. A further preferred embodiment includes an additional cavity formed in the cover that provides a cup measuring the desired amount of hot water for heating the towels.

DESCRIPTION OF THE PREFERRED EMBODIMENTS

While the invention will be described in connection with certain preferred embodiments, it is to be understood that the invention is not to be limited to those embodiments. On the contrary, it is intended to cover all alternatives, modifications and equivalents as can be included within the spirit and scope of the invention as defined in the appended claims.

Figure 1:
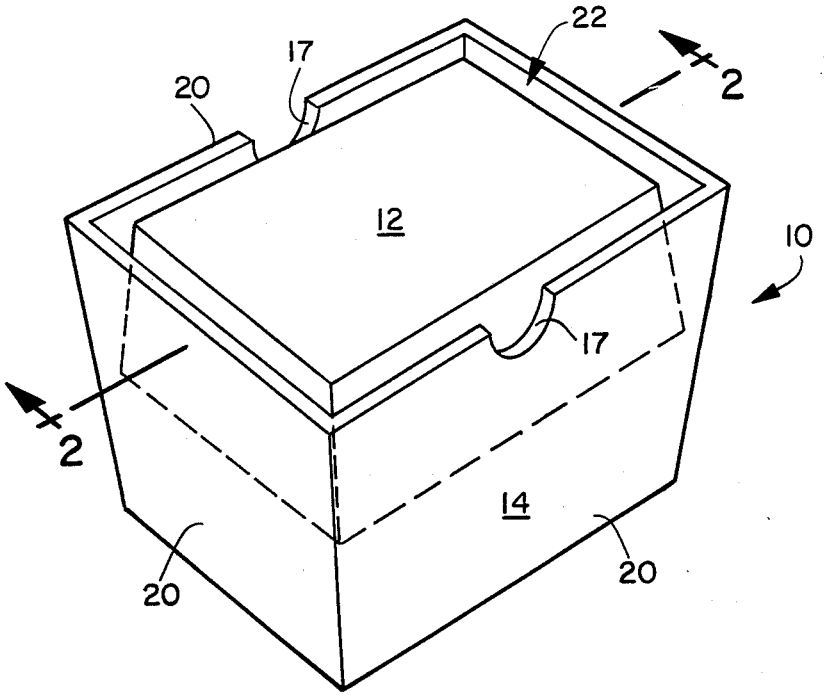
FIG. 1 is a perspective view of the container of the present invention in a closed form.
Figure 2:
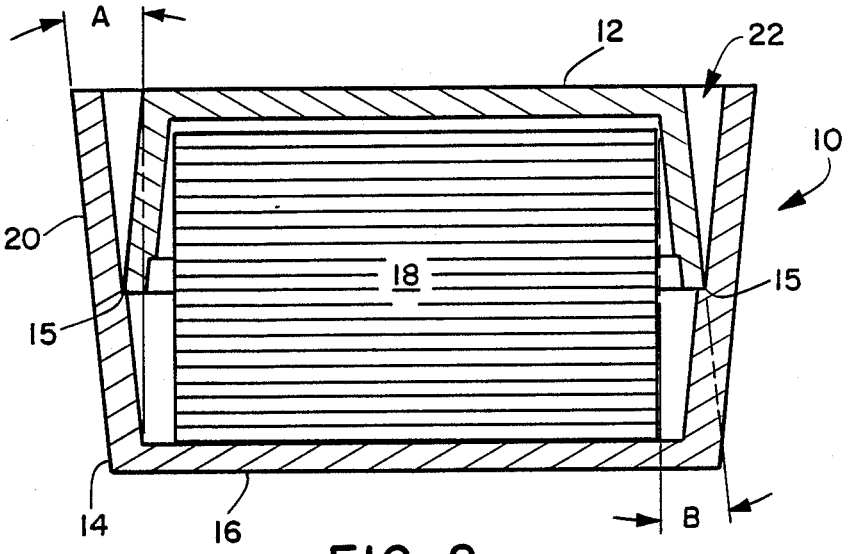
FIG. 2 is a cross-section of the container of FIG. 1 taken along lines 2—2 and showing the towel contents.

Turning to FIGS. 1 and 2, there is illustrated in perspective and in cross-section a container 10 in accordance with the present invention. As shown, container 10 generally includes top 12 and bottom 14. Bottom 14 has a flat base surface 16 with dimensions generally determined by the arrangement of towel contents stack 18. That is, for convenience, if the towels are arranged in a rectangular stack the base cavity and, as a consequence, the flat surface will normally be rectangular and of a size adequate to contain the stack. In accordance with preferred embodiments of the invention, however, the bottom 14 has self-supporting sides 20 that extend outwardly so that the upper opening of bottom 14 is larger than base 16. While the degree to which the sides extend outwardly is not critical, preferably they form an angle A as shown with an imaginary line extending at ninety degrees to the base, and the angle is preferably in the range of from about 0° to 30° with the range of 4° to 10° being most preferred. The size and shape of top 12 is determined by that of bottom 14 so as to provide a closure. As shown, preferably the outside dimensions of the top 12 which contact the opening 22 of bottom 14 are just enough smaller than the opening dimensions so that a pressure fit may be obtained by forcing cover 12 into the opening of bottom 14. In a further preferred embodiment, bottom 14 contains a notch 15 on at least two, preferably all four, inside surfaces of walls 20 so as to lock in the edges of top 12. From the bottom opening contacting portion of top 12, the top includes tapered sides 24 which are formed at an angle selected so that, when inverted, top 12 will nest within bottom 14 leaving sufficient space for liquid to pass and be released from bottom 14. While, for this purpose, many variations will be apparent to those skilled in the art, preferably the top sides are formed at an angle B as shown from an imaginary vertical line that is in the range of from about 2° to 32°, most preferably, 6° to 16°, and at least about 2 degrees greater than the angle A of slope of the bottom sides, most preferably in the range of from about 2 to 10 degrees greater. Top 12 preferably terminates in a flat portion 27 which may be used as discussed below for forcing release of excess water. The upper edges of bottom 14 may contain two or more opposing notches 17 to facilitate removal of top 12. As shown, to reduce storage space, top 12 preferably nests within bottom 14 in the closed position and is level with the top of bottom sidewalls 20.

Figure 3:
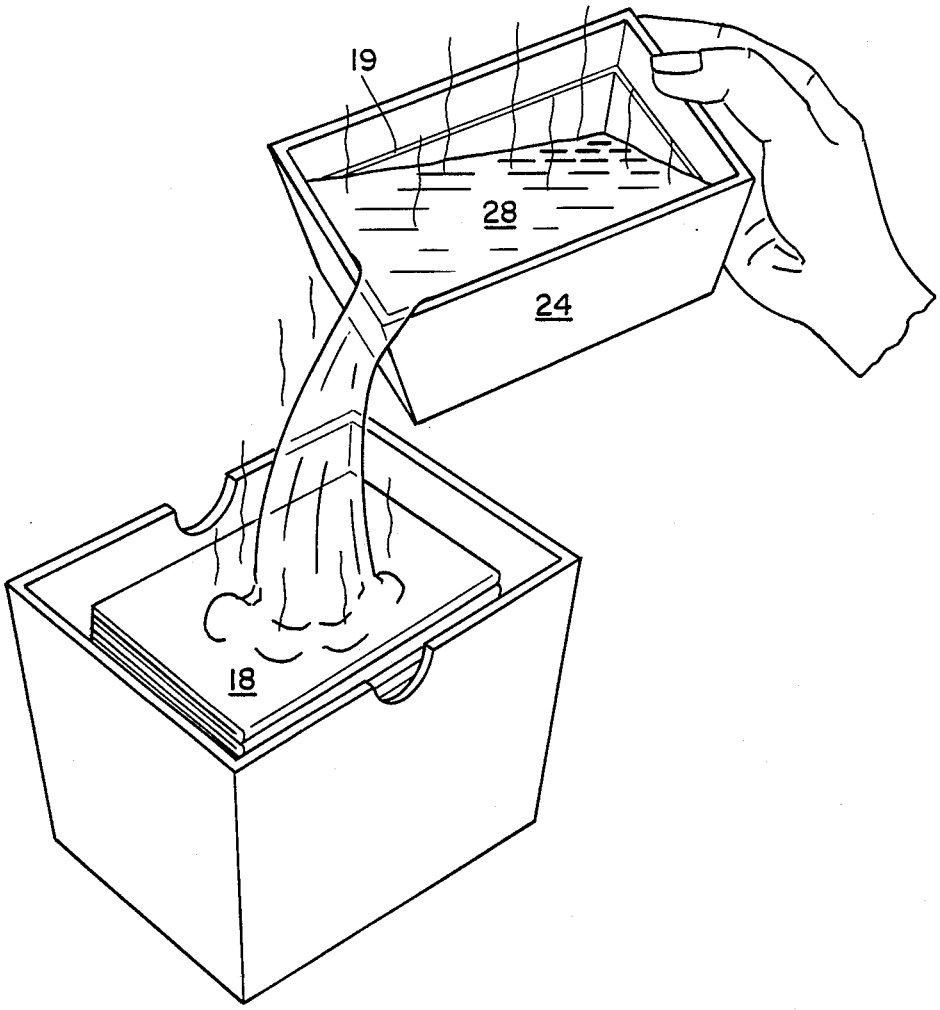
FIG. 3 illustrates the container of FIG. 1 in an open configuration and receiving hot water for moistening the towel contents.

Turning to FIG. 3, the container of FIG. 1 is shown with the top removed, filled with hot water 28, and towel contents 18 being heated by the addition of the hot water. In a preferred embodiment, top 12 is generally hollow and the hollowed-out cavity portion is of a predetermined volume and is marked, such as by line 19, so that the amount of hot water 28 needed to provide the desired degree of saturation of contents 18 may be readily determined. In this manner the need for other measuring means is avoided.

Figure 4:
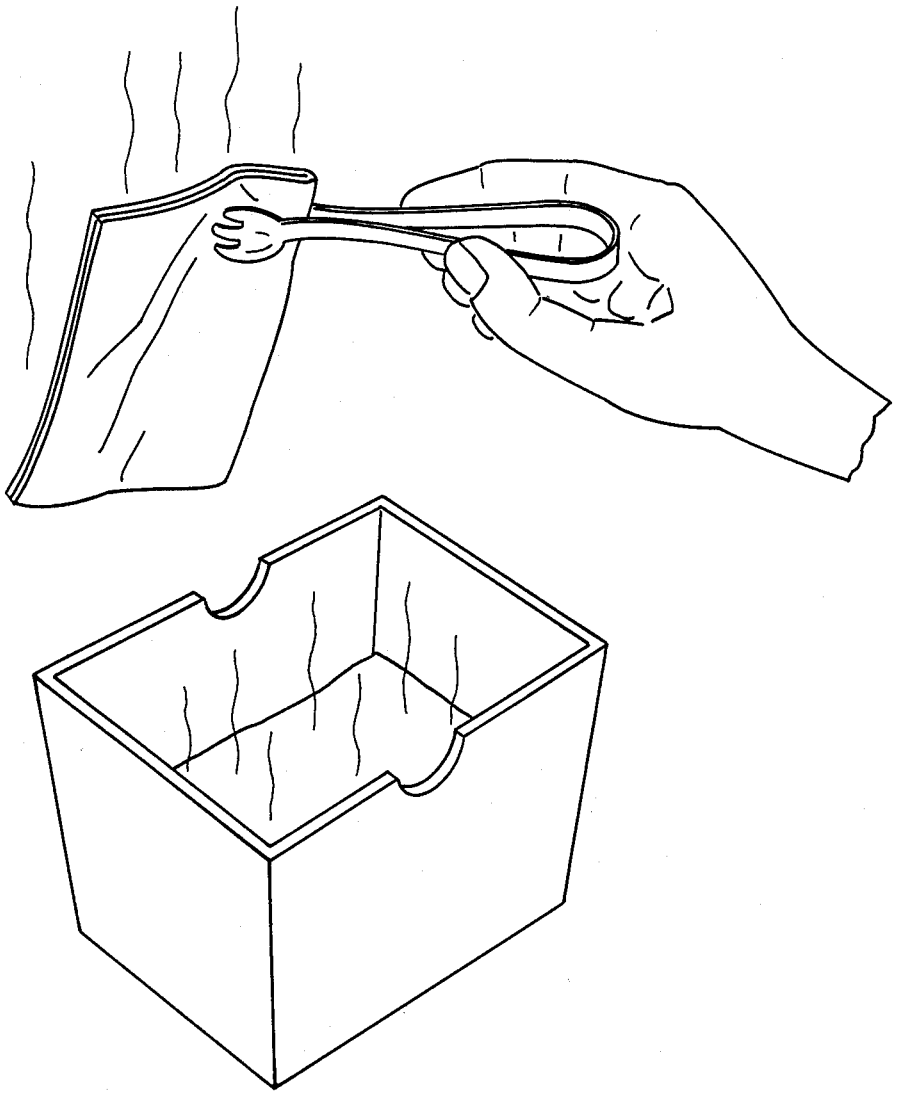
FIG. 4 illustrates the container of FIG. 3 with the top removed and ready for dispensing hot, moist towels.

As shown in FIG. 4, the moist, hot towels may be readily removed and dispensed to airline passengers or other users. Once the towels have been dispensed, the bottom may act as a convenient collector for the used towels, and the entire contents and container may be discarded.

Figure 5:
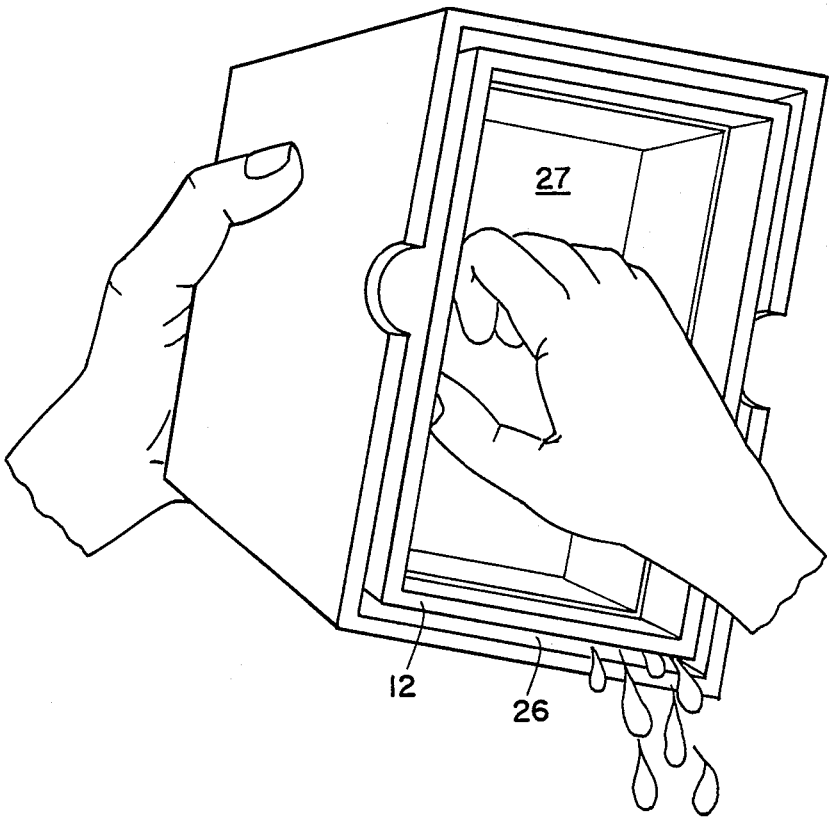
FIG. 5 illustrates the container of FIG. 2 after remoistening unused towels and with the top positioned to squeeze out excess moisture.

Turning to the preferred embodiment of FIG. 5, once the towel contents 22 have been saturated with hot water, excess water may be removed by pressing top 12 in an inverted position against the contents within bottom 14. In a preferred embodiment the taper of sides 24 of top 12 is selected so that sufficient space 26 remains between the sides 24 of the top and sides 20 of the bottom to permit the water to be readily drained. For this purpose top 12 preferably has flat portion 27.

In accordance with a further aspect of the present invention, the bottom portion, at least, of the container is formed at least partially of material having sufficient rigidity to retain its shape under use conditions and a relatively high heat insulating value. Preferably the material has an "R" value per inch of thickness expressed as $Ft^2$ ° F. hour per Btu of at least 2. Certain polystyrenes have a value expressed in such terms as 6.37, for example. This provides dual advantages of facilitating handling of the container including hot towels and hot water as well as extending the period of time that the moist towels remain hot for dispensing purposes. Such materials of high insulating values are well known and include materials such as foamed rubbers, foamed plastics, and corrugated or multi-walled papers. The preferred material of construction is expanded small-bead polystyrene, since it may be readily formed into the desired shape and is of low cost.

While it is not as essential that top 12 be formed of such heat insulating material, it is preferred, particularly when top 12 is to be used as a measuring device for the addition of hot water or to be used to squeeze out excess hot water. In the absence of such a requirement, top 12 may be formed of any material consistent with its shape retention and cost requirements. Such other materials include, for example, nonfoamed plastics.

The towels, while not forming part of the present invention, may be needle-punched or formed of woven textile materials. For many applications, disposable towels formed of nonwoven or paper materials are preferred for cost and convenience. These fabrics will have sufficient wet strength properties to withstand the application of hot water, dispensing and use of the towels. Such materials are well known for wet wipe applications and include nonwovens such as carded webs, meltblown webs, spunbonded webs and spunlaced webs. Preferred towel materials are woven cotton and meltblown polyethylene.

As discussed above, the general shape of the container will visually be determined by the towels to be dispensed. While rectangular shapes are desired as providing a compact package that may be readily handled and stored, other shapes such as circular, oval, and the like may be used.

EXAMPLE

A container in accordance with the invention and as illustrated in FIGS. 1–5 was made by expanded polystyrene molding The bottom had a rectangular base surface with the following outside dimensions $5\frac{1}{4}$ inches×$7\frac{1}{4}$ inches (13.3 cm×18.4 cm). The sides had an outward slope at 6° from vertical, and the material of construction was expanded small bead polystyrene at a thickness of $\frac{3}{8}$ inches (0.95 cm) This resulted in an interior volume of 1708 cc and interior base dimensions of $4\frac{3}{8}$ inches×$6\frac{3}{8}$ inches (11.1 cm×16.2 cm). The height of the interior cavity was $3\frac{3}{4}$ inches (9.5 cm). The top was formed of the same material at the same thickness with sides sloping inward at an angle of 9° from vertical and a height of $1\frac{7}{8}$ inches (4.8 cm) so that the top surface on the outside formed a rectangle having an area of 1804 $cm^2$. The volume of the top cavity to fill line was 666 cc which was determined to conveniently hold the amount of water desired to sufficiently moisten the intended towel contents.

A stack of 25 towels of an individual rectangular shape of 14 cm×8.1 cm and 113 square centimeters in area was placed into the bottom of the container, and the top cavity was filled with hot water at a temperature of 185° F. (85° C.) to the fill line. This water was then poured over the towels, saturating them. The towels were then dispensed one at a time and over a period of about 30 minutes, and it was observed that the last towel remained warm and moist. After dispensing, the used towels were collected in the dispenser, the top replaced and the entire contents discarded.

When compared with the time necessary to saturate reusable washcloths, dry them, and collect them for reuse, and considering the amount of storage and preparation time involved with conventional practice, the present invention provides a highly efficient and quick means for preparing and dispensing hot, moist towels. As a result, this hot towel feature may be made more readily available and enhance the comfort of users, particularly those involved in commercial airline travel. The availability of compact storage in accordance with the invention also adds to the advantages and may make the use of such hot, moist towels on smaller aircraft more readily available.

Thus it is apparent that there has been provided, in accordance with the invention, an improved preparing and dispensing container for hot, moist towels that fully satisfies the objectives, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A container adapted to be used in storing, moistening, heating and dispensing hot, moist towels comprising, a bottom formed at least partially of a heat insulating material having sufficient rigidity to retain its shape under use conditions and having a cavity that is of a size and shape to receive a plurality of towels and having self-supporting sidewalls forming a top opening, and a cover having a size and shape to engage said bottom sidewalls and having sidewalls that are tapered so that the exposed top surface is smaller than said top opening so that, when inverted, said cover can extend into said bottom cavity top opening and contact such towels without sealing engagement between said bottom sidewalls and said top sidewalls.

2. The container of claim 1 wherein the bottom sidewalls extend outwardly to form an angle with an imaginary line perpendicular to the container bottom base in the range of from about 0° to about 30° and the sidewalls of the top form such an angle that is at least 2° greater.

3. The container of claim 2 wherein the cover fits within the bottom in the closed position and the inside bottom walls contain a notch to lock the cover in the closed position.

4. The container of claim 3 wherein the cover in the closed position is generally level with the top of the sidewalls of the bottom.

5. The container of claim 2 wherein the cover edge of at least one sidewall contains a notch to facilitate removal of the top from the closed position.

6. The container of claim 2 wherein the bottom sidewall angle is in the range of from about 4° to about 10°.

7. The container of claims 6 or the cover sidewall angle is in the range of from about 2° to about 30° taken from an imaginary vertical line.

8. The container of claim 7 wherein the cover sidewall angle is in the range of from about 6° to about 16°.

9. The container of claim 1 wherein the cover contains a cavity of sufficient size and marked to contain a predetermined amount of hot water to heat and moisten the towel contents.

10. The container of claims 1, 2, 3, 5 or 9 wherein the insulating material is expanded polystyrene.

11. The container of claim 10 wherein the cover is also from expanded polystyrene.

* * * * *